United States Patent [19]

Haglund et al.

[11] 4,282,519

[45] Aug. 4, 1981

[54] INTERCONNECTION OF ALARMS OF SMOKE DETECTORS WITH DISTINGUISHABLE ALARMS

[75] Inventors: Stephen A. Haglund, Minnetonka; Robert L. Payne, Crystal, both of Minn.

[73] Assignee: Honeywell Inc., Minneapolis, Minn.

[21] Appl. No.: 839,874

[22] Filed: Oct. 6, 1977

[51] Int. Cl.[3] ..... G08B 17/10; G08B 21/00

[52] U.S. Cl. ..... 340/628; 340/629

[58] Field of Search ..... 340/627, 628, 629, 630, 340/524, 506, 514, 529, 525, 326

[56] References Cited

U.S. PATENT DOCUMENTS

| | | | |
|---|---|---|---|
| 3,832,552 | 8/1974 | Larsen et al. | 250/381 |
| 4,019,139 | 4/1977 | Ortega | 340/224 X |

FOREIGN PATENT DOCUMENTS

| | | | |
|---|---|---|---|
| 479928 | 2/1938 | United Kingdom . | |
| 1025589 | 4/1966 | United Kingdom . | |
| 1351748 | 5/1974 | United Kingdom | 340/514 |

OTHER PUBLICATIONS

RCA Digital Integrated Circuits, Application Note ICAN-6267, Nov. 1973, pp. 531-533.

*Primary Examiner*—John W. Caldwell, Sr.
*Assistant Examiner*—Daniel Myer
*Attorney, Agent, or Firm*—Clyde C. Blinn

[57] ABSTRACT

A smoke detection alarm system which has at least one detector and alarm in each of the plurality of areas with an interconnection circuit whereby upon the detection of an abnormal smoke condition in any one of the areas, the annunciator or horn of the detector in the area having the abnormal condition is operated with a steady tone and the annunciators of the other detectors in other areas are operated in an intermittent tone so that an occupant of an area can determine by the sound of the tone from the annunciator whether the abnormal condition is in the area in which he is located or in a remote area.

4 Claims, 1 Drawing Figure

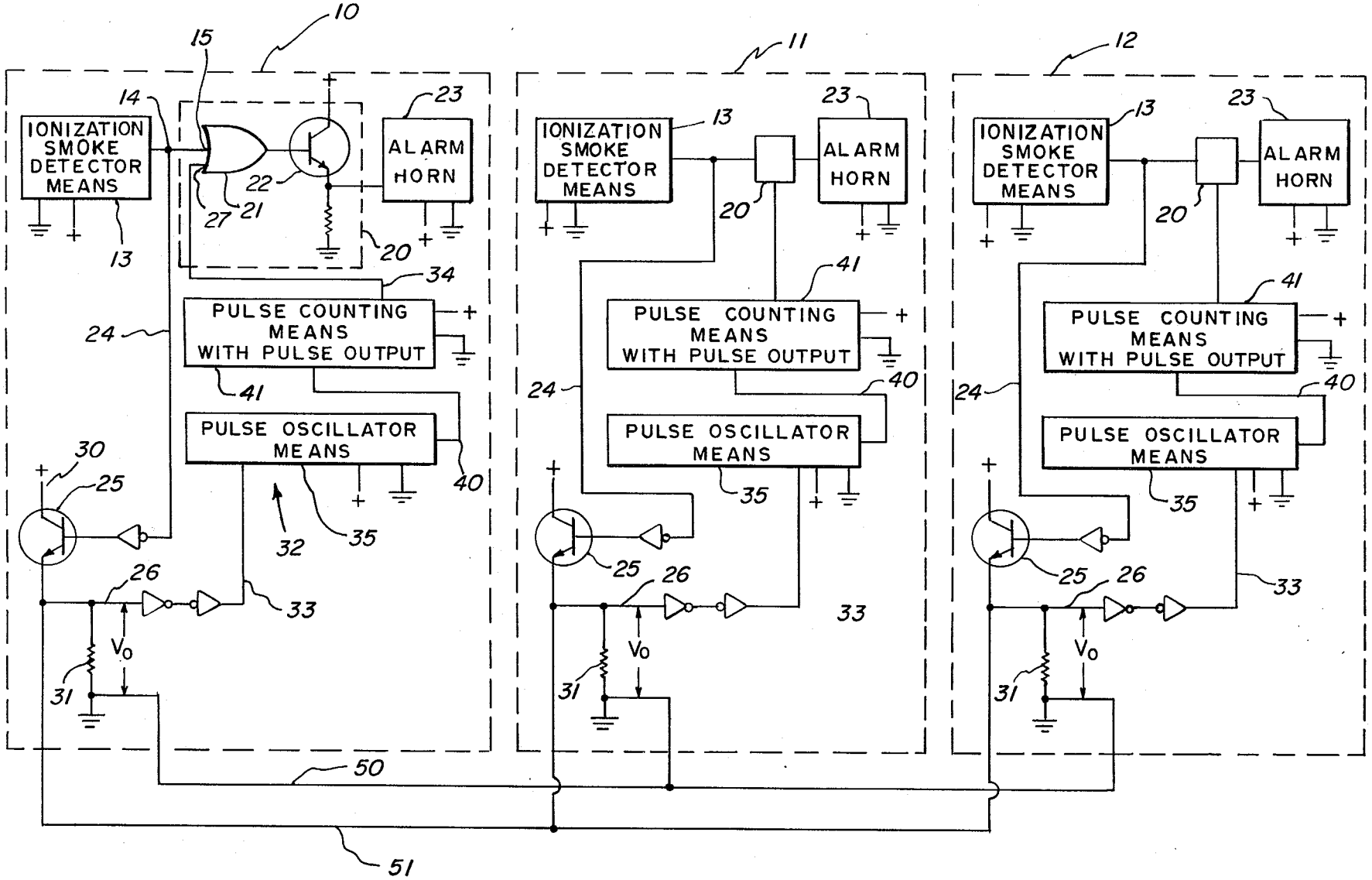
ALARM HORN
IONIZATION SMOKE DETECTOR MEANS
PULSE COUNTING MEANS WITH PULSE OUTPUT
PULSE OSCILLATOR MEANS
$V_0$
10
11
12
13
14
15
20
21
22
23
24
25
26
27
30
31
32
33
34
35
40
41
50
51

INTERCONNECTION OF ALARMS OF SMOKE DETECTORS WITH DISTINGUISHABLE ALARMS

BACKGROUND AND SUMMARY OF THE INVENTION

With the advent of ionization type smoke detectors of the type shown in the Larry D. Larsen et al U.S. Pat. No. 3,832,552 issued Aug. 27, 1974, and the increased public awareness of the need of smoke and fire detectors in dwellings, a continual improvement in the design of such smoke detectors and the interconnecting systems associated with such detectors is being accomplished.

When a smoke detector of the type shown in the Larry D. Larsen et al patent is used in each of a plurality of areas, conventional circuit means are provided for interconnecting the annunciators or horns of the individual detectors so that upon the presence of an abnormal condition in one of the areas all of the horns will be operated to provide an alarm to the occupants in some remote area of the dwelling. Whenever a fire occurs in a dwelling having a plurality of areas, each having a smoke detector, upon the presence of an alarm by the sounding of the horns of each of the detectors, the occupant heretofore had no way of knowing whether the fire was in one area or another.

The present invention is concerned with a system of interconnecting individual abnormal condition responsive devices or smoke detectors so that upon the presence of smoke in one area, the operation of the horn is such that the occupant would be able to determine whether the abnormal condition is in the area in which he is located or in a remote area. Specifically, when a smoke detector in the area in which the smoke exists is energized, the horn is operated continuously and the detector has a horn energization circuit whereby by means of an interconnecting circuit the detectors of the remote areas will have their horns operate in an intermittent manner. The invention is disclosed in the following specification and drawing of which A single FIGURE shows the abnormal condition alarm system wherein a plurality of individual smoke detectors and alarm devices are interconnected to provide for a different type of operation of the alarm horn depending upon the location of the abnormal condition.

DESCRIPTION OF THE INVENTION

A plurality of abnormal condition alarm devices or ionization smoke detector devices 10, 11 and 12 are shown which each might be placed in individual areas or zones and interconnected into a system. While only three devices are shown, it should be understood that other devices can be interconnected, however, the operation can be described with only three. Each of the devices 10, 11 and 12 has an ionization smoke detector means of the type shown in the mentioned Larsen et al patent wherein an electrical output at 14 is provided upon the presence of an abnormal condition or smoke above a predetermined value. The output at 14 is connected to one of the inputs 15 of an annunciator or horn control circuit 20. Circuit 20 comprises an OR gate 21 and a horn relay or transistor 22 for providing a signal to energize the annunciator or alarm horn 23. Output 14 is also connected by a conductor 24 to a switch means or transistor 25 which upon biasing the transistor to a conductive state, a power source 30 is connected to cause current to flow through an impedance or resistor 31 to ground for providing a second output signal at 26 which is actually the voltage $V_o$ which exists across resistor 31.

An annunciator or alarm horn control circuit 32 is connected to the second output signal $V_o$ at 26 through a circuit 33 to provide another output over circuit 34 to a second input 27 of gate 21 for energizing the horn. Annunciator circuit 32 comprises a pulse oscillator means 35 of a conventional type such as that shown in the RCA Solid State Division, Digital Integrated Circuits, Application Notes ICAN-6267 published Nov., 1973. Oscillator means 35 when energized has a frequency output at 40 to be connected to a pulse counting means 45 of the type described on pages 416 and 417 of the RCA Integrated Circuits Data Book of Apr., 1976, which has a pulse output at circuit 34. Upon the conduction of transistor 25 to provide the second output $V_o$ at 26, oscillator means 35 is energized and pulse counting means 41 will count the pulses of the oscillator means and provide a pulsing output over 34 to intermittently operate horn 23 in a second type of operation as distinguished from a steady or first type of operation as previously mentioned when the horn is energized directly from the ionization smoke detector means through input circuit 15.

Each of the detectors 10, 11 and 12 while having their own independent power source whether it be from a separate AC source or a battery source, are interconnected by two wires 50 and 51 which might be low voltage wires and thus not requiring special installation. Obviously, a common ground might require only wire 51. Wires 50 and 51 are connected to each detector means to either respond to the voltage $V_o$ developed across resistor 31 and conduct the voltage to the input circuits at 26 of the annunciator circuit 32 of the other detectors or to conduct the voltage from another detector to the input circuit at 26 of the annunciator of detector 10. Upon the conduction of the transistor 25 of any one of the detectors 10, 11 or 12 upon the presence of an output from the ionization smoke detector means 13, the second output at $V_o$ at 26 is provided and this output is placed on the two wires 50 and 51 to be transmitted to the other detectors so that the horn annunciator means 32 of all the detectors are thus energized.

When the detector which senses the presence of smoke such as 10, energizes its horn 23 directly through the input 15 to provide for one type of operation of the horn, the energization of the horn 23 by the horn annunciator circuit 32 of detector 10 has no significance. The energization of the horn directly by the first type of operation dominates the energization of the horn through circuit 32. For the other detectors which have no direct energization of the horn through their ionization smoke detector means 13, the horn is energized through the pulsing operation accomplished over the annunciator circuit 32 of their individual detector circuits.

OPERATION OF THE INVENTION

When a plurality of detectors such as 10, 11 and 12 are connected into a system having each of the detectors in a definite area, the only interconnection provided between the detectors is the wires 50 and 51. Upon the presence of an abnormal condition or smoke in any one of the areas such as the area having detector 10, the alarm horn 23 is energized by a dominating or first type of operation through the output from the ionization smoke detector means 13 to input 15. At the same time, the output of the ionization smoke detector means 13 causes transistor 25 to become conductive to produce the second output or voltage $V_o$. The voltage $V_o$ or the second output signal is also impressed upon the horn annunciator control circuit 32 of the other detectors over the wires 50 and 51 to bring about a second type of pulsating operation of the horns of detectors 11 and 12. By means of this alarm system, an occupant of the area having detector 11, upon the presence of the smoke condition in the area having detector 10, would hear a pulsating horn operation which would inform him that while there was a fire to produce smoke in the dwelling, the area in which he is in does not have the fire. At the same time, an occupant in the area having detector 10 would hear a steady horn and even if he did not smell or was not aware of the presence of the smoke, he would known that the smoke originating the alarm condition was from the area in which he is located.

The embodiments of the invention in which an exclusive property or right is claimed are defined as follows:

1. In a circuit of an abnormal condition detector alarm device adapted to be connected to other such devices to provide an interconnection of annunciator operation, each of the devices comprising condition responsive means having an output upon the presence of an abnormal condition, first annunciator means connected to said condition responsive means output to provide a steady type of energization of said annunciator means upon the presence of said output, switch means controlled by said condition responsive means output for controlling the supply of power from a source of power, first circuit means connected to said switch means and to said source of power when said switch means is operated to provide a second output, second circuit means connecting said second output to said first annunciator means to provide an intermittent type of energization of said annunciator means, and third circuit means adapted to connect said second output to a second circuit means of a second annunciator means of a remote second condition detector alarm device to provide an intermittent type of energization of said second annunciator means and upon an operation of a switch means of said remote second condition detector alarm device, a second output of said second device is adapted to provide said intermittent type of energization of said first annunciator means.

2. The invention of claim 1, wherein, said first circuit means comprises an impedance through which current flows when said switch means is closed thereby providing said second output, said second circuit means comprises a pulse forming means to intermittently energize said first annunciator means, and said third circuit means comprises circuit connections from said impedance to a second impedance of said second device to provide a second output for said second device and said second impedance of said second device provides said second output when said first annunciator means is to be operated by the abnormal condition detected by said second device.

3. In a circuit for a plurality of abnormal condition detector alarm devices each comprising;

an abnormal condition responsive means having a first output upon the presence of an abnormal condition, an annunciator means energized in a first type of operation upon the presence of said first output, switch means controlled by said first output, first circuit means producing a second output when said switch means is operated upon the presence of an abnormal condition, annunciator circuit control means connected to said annunciator means and having an input circuit responsive to said second output for energizing said annunciator means in a second type of operation which would be dominated by said first type of operation, and second circuit means interconnecting said first circuit means of all of said plurality of said devices whereby upon one of said devices sensing an abnormal condition and having said first output, said annunciator means of said one device is operated with a first type of operation and said second output of said one device is connected to said annunciator circuit control means of the other of said plurality of devices to energize their annunciator means with a second type of operation to indicate that the abnormal condition is at said one of said devices.

4. The invention of claim 3 wherein said switch means of each device is a transistor biased on by said first output, said first circuit means is a resistance connected to a source of power when said transistor turns on, said second output is a voltage drop across said resistance, and said annunciator circuit control means is an oscillator pulse circuit and pulse counter circuit providing a pulsing output to said annunciator means when a voltage drop exists across said resistance of any one of said devices to energize all of said annunciator circuit control means.

* * * * *